US007614810B2

(12) United States Patent
Naito

(10) Patent No.: US 7,614,810 B2
(45) Date of Patent: Nov. 10, 2009

(54) PRINTER

(75) Inventor: Tadahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 312 days.

(21) Appl. No.: 11/523,044

(22) Filed: Sep. 19, 2006

(65) Prior Publication Data

US 2007/0127966 A1 Jun. 7, 2007

(30) Foreign Application Priority Data

Dec. 1, 2005 (JP) ..... 2005-347413

(51) Int. Cl.
*B41J 11/00* (2006.01)

(52) U.S. Cl. ..... 400/615.2; 400/583

(58) Field of Classification Search ..... 400/615.2, 400/583

See application file for complete search history.

(56) References Cited

U.S. PATENT DOCUMENTS

| | | | | |
|---|---|---|---|---|
| 4,616,236 | A | 10/1986 | Watanabe et al. | |
| 5,005,998 | A * | 4/1991 | Takanashi et al. | 400/208 |
| 5,305,020 | A | 4/1994 | Gibbons et al. | |
| 5,368,402 | A * | 11/1994 | Takahashi et al. | 400/279 |
| 5,384,584 | A * | 1/1995 | Yoshida et al. | 347/215 |
| 6,099,179 | A * | 8/2000 | Higashi et al. | 400/613 |
| 6,426,801 | B1 * | 7/2002 | Reed | 358/1.16 |
| 2002/0051027 | A1 | 5/2002 | Kyogoku et al. | |
| 2003/0231341 | A1 * | 12/2003 | Aichi et al. | 358/1.15 |
| 2005/0100385 | A1 * | 5/2005 | Sato | 400/708 |
| 2005/0162494 | A1 * | 7/2005 | Inokuchi et al. | 347/104 |

FOREIGN PATENT DOCUMENTS

| | | |
|---|---|---|
| JP | 2003-177891 A | 6/2003 |
| JP | 2004-064740 A | 2/2004 |
| JP | 2004-129221 A | 4/2004 |

OTHER PUBLICATIONS

Great Britain Search Report dated Jan. 12, 2007 (one (1) page).

* cited by examiner

*Primary Examiner*—Anthony H. Nguyen
(74) *Attorney, Agent, or Firm*—Crowell & Moring LLP

(57) ABSTRACT

A printer allowing changes of a paper size and an ink sheet in an intermediate stage of printing is obtained. This printer comprises a paper tray provided in correspondence to each of a plurality of paper sizes, a paper tray detecting portion for detecting the size of the paper corresponding to the paper tray, an ink sheet cartridge provided in correspondence to each of a plurality of types of ink sheets corresponding to the plurality of paper sizes respectively, a cartridge detecting portion for detecting the type of the ink sheet corresponding to the ink sheet cartridge and a control portion finally deciding a combination of a paper and the ink sheet subjected to printing after searching for the paper and the ink sheet.

15 Claims, 8 Drawing Sheets

DECISION OF SIZE OF PAPER AND TYPE OF INK SHEET

PRINTER

BACKGROUND OF THE INVENTION

1. Field of the Invention

The present invention relates to a printer, and more particularly, it relates to a printer comprising a paper tray and an ink sheet cartridge.

2. Description of the Background Art

A printer comprising a paper tray and an ink sheet cartridge is known in general, as disclosed in Japanese Patent Laying-Open No. 2003-177891, 2004-129221 or 2004-64740, for example.

The aforementioned Japanese Patent Laying-Open No. 2003-177891 discloses a printer storing the residues of photographic papers (papers) in a paper tray and an ink ribbon (ink sheet) in a ribbon case (ink sheet cartridge).

The aforementioned Japanese Patent Laying-Open No. 2004-129221 discloses a printer performing printing by setting printing conditions such as the size of papers employed for printing, thereafter receiving image data from a digital camera and feeding the papers. If a paper feed error occurs in paper feeding, the digital camera transmits the result of a determination made by a user as to whether to continue or to stop printing, so that the printer returns to the state after setting the printing conditions for continuing the printing when the user determines to continue the printing.

The aforementioned Japanese Patent Laying-Open No. 2004-64740 discloses a printer performing printing by setting printing conditions such as the size of papers employed for printing, thereafter receiving image data from a digital camera and feeding the papers.

However, the aforementioned Japanese Patent Laying-Open No. 2003-177891 does not describe the sizes of the photographic papers in detail, and hence the printer conceivably employs only a single type of papers. In this printer, it is disadvantageously difficult to perform printing when the photographic papers (papers) of this size are used up.

The conventional printer proposed in the aforementioned Japanese Patent Laying-Open No. 2004-129221 feeds the papers after setting the printing conditions such as the size of the papers and continues printing by returning to the state after setting the printing conditions upon occurrence a paper feed error such as a shortage of the papers or an ink sheet. Therefore, the printer cannot continue printing unless the papers of the set size are or the ink sheet is supplemented. Also when the printer possesses papers of a size other than the set size or an additional ink sheet, therefore, it is disadvantageously difficult for the printer to perform printing with these papers or this ink sheet if the papers are or the ink sheet is in short supply in an intermediate stage of a printing operation such as paper feeding.

The aforementioned Japanese Patent Laying-Open No. 2004-64740 describes no processing in a case of a paper feed error in paper feeding. If the printer according to Japanese Patent Laying-Open No. 2004-64740 is similar to that according to aforementioned Japanese Patent Laying-Open No. 2004-129221, the printer cannot continue printing when the papers are or an ink sheet is in short supply unless the papers of the set size are or the ink sheet is supplemented. Also when the printer possesses papers of a size other than the set size or an additional ink sheet, therefore, it is disadvantageously difficult for the printer to perform printing with these papers or this ink sheet if the papers are or the ink sheet is in short supply in an intermediate stage of a printing operation such as paper feeding.

SUMMARY OF THE INVENTION

The present invention has been proposed in order to solve the aforementioned problems, and an object of the present invention is to provide a printer allowing changes of a paper size and an ink sheet in an intermediate stage of printing.

A printer according to a first aspect of the present invention comprises a paper tray provided in correspondence to each of a plurality of paper sizes, a paper tray detecting portion for detecting the paper size corresponding to the paper tray, an ink sheet cartridge provided in correspondence to each of a plurality of types of ink sheets corresponding to the plurality of paper sizes respectively, a cartridge detecting portion for detecting the type of the ink sheet corresponding to the ink sheet cartridge and a control portion finally deciding a combination of a paper and the ink sheet subjected to printing after searching for the paper and the ink sheet.

The printer according to the first aspect of the present invention, comprising the control portion finally deciding the combination of the paper and the ink sheet subjected to printing after searching for the paper and the ink sheet as hereinabove described, can change the combination, not yet finally decided, of the paper and the ink sheet subjected to printing decided if the same detects a shortage of the paper and/or the ink sheet when searching for the paper and the ink sheet in printing. Also when the paper and/or the ink sheet is in short supply in the search for the paper and the ink sheet in printing, therefore, the printer can perform printing by exchanging the paper and the ink sheet for a paper of another size and another ink sheet corresponding thereto respectively.

In the aforementioned printer according to the first aspect, the control portion preferably virtually decides a combination of the paper size corresponding to the paper tray detected by the paper tray detecting portion and the type of the ink sheet corresponding to the ink sheet cartridge detected by the cartridge detecting portion before searching for the paper and the ink sheet when the combination is a printable combination. According to this structure, the printer can search for the paper and the ink sheet only in the case of the printable combination, not to search for a paper and an ink sheet of a nonprintable combination.

In this case, the control portion preferably does not virtually decide the combination of the paper size corresponding to the paper tray detected by the paper tray detecting portion and the type of the ink sheet corresponding to the ink sheet cartridge detected by the cartridge detecting portion but posts abnormality to a user before searching for the paper and the ink sheet when the combination is not a printable combination. According to this structure, the user can easily recognize that the paper size and the type of the ink sheet abnormally correspond to each other (in a nonprintable combination) when mounting the paper tray and the ink sheet cartridge on the printer.

In the aforementioned printer according to the first aspect, the control portion preferably exercises control for finally deciding the combination of the paper and the ink sheet subjected to printing and performing printing when normally searching for the paper and the ink sheet, and finally decides the combination of the paper and the ink sheet subjected to printing after searching for the paper and the ink sheet again after exchanging at least either the paper tray or the ink sheet cartridge when abnormally searching for the paper and the ink sheet. According to this structure, the printer can easily finally decide the combination of the exchanged paper and the ink sheet after searching for the paper and the ink sheet by exchanging the paper and the ink sheet for a paper of another size and another ink sheet corresponding thereto respectively when the paper and/or the ink sheet is in short supply.

In this case, the control portion preferably posts a shortage of the ink sheet to a user when abnormally searching for the ink sheet. According to this structure, the user can easily recognize that the ink sheet must be exchanged.

In the aforementioned structure exercising control for finally deciding the combination of the paper and the ink sheet subjected to printing and performing printing, the control portion preferably virtually decides a combination of the paper size corresponding to the paper tray detected by the paper tray detecting portion and the type of the ink sheet corresponding to the ink sheet cartridge detected by the cartridge detecting portion when the combination is a printable combination, and preferably determines that the paper is abnormally searched out and posts a paper error to a user if the paper is in short supply and if the paper size determined when searching for the paper and the virtually decided paper size corresponding to the paper tray detected by the paper tray detecting portion do not correspond to each other. According to this structure, the user can easily recognize that the paper must be supplemented if the paper is in short supply, and that the paper currently stored in the paper tray must be exchanged for another paper of the printable size due to the size different from that of an originally printable paper.

In the aforementioned printer according to the first aspect, the paper tray detecting portion preferably detects the paper size corresponding to the paper tray and the cartridge detecting portion preferably detects the type of the ink sheet corresponding to the ink sheet cartridge every time the printer performs printing on a single paper. According to this structure, the printer can easily continuously perform printing also when detecting a shortage of the paper and/or the ink sheet in an intermediate stage of printing on a plurality of papers by exchanging the paper tray and the ink sheet cartridge for those storing the paper and the ink sheet of the printable combination respectively.

The aforementioned printer according to the first aspect preferably further comprises a paper detecting portion for detecting a carried position of the paper, and the control portion preferably determines whether or not the paper has been normally searched out on the basis of a result of detection by the paper detecting portion. According to this structure, the printer can easily determine whether or not the paper has been normally searched out.

In this case, the printer preferably further comprises a carrier roller whose rotational frequency is detected by the control portion, and the control portion preferably determines the paper size on the basis of a result of detection of the rotational frequency of the carrier roller required by the paper detecting portion for detecting the rear end of the paper after detecting the front end of the paper. According to this structure, the control portion can easily determine the size of the paper carried to the printer by calculating the distance between the front and rear ends of the paper from the rotational frequency of the carrier roller required by the paper detecting portion for detecting the rear end of the paper after detecting the front end of the paper.

In the aforementioned printer according to the first aspect, the control portion preferably finally decides the combination of the paper and the ink sheet subjected to printing after searching for the paper and the ink sheet in response to a print instruction signal received from an image pickup apparatus. According to this structure, the printer can perform printing directly from the image pickup apparatus without through a personal computer or the like.

A printer according to a second aspect of the present invention comprises a paper tray provided in correspondence to each of a plurality of paper sizes, a paper tray detecting portion for detecting the paper sizes, an ink sheet cartridge provided in correspondence to each of a plurality of types of ink sheets corresponding to the plurality of paper sizes respectively, a cartridge detecting portion for detecting the types of the ink sheets, a paper detecting portion for detecting a carried position of a paper and a control portion receiving results of detection from the paper tray detecting portion, the cartridge detecting portion and the paper detecting portion, while the paper tray detecting portion detects the paper size corresponding to the paper tray, the cartridge detecting portion detects the type of the ink sheet corresponding to the ink sheet cartridge, and the control portion virtually decides a combination of the paper size corresponding to the paper tray detected by the paper tray detecting portion and the type of the ink sheet corresponding to the ink sheet cartridge detected by the cartridge detecting portion and searches for the paper and the ink sheet when the combination is a printable combination every printing performed on a single paper in response to a print instruction signal received from an image pickup apparatus, determines whether or not the paper has been normally searched out on the basis of a result of detection of the paper detecting portion on the carried position of the paper, exercises control for finally deciding the combination of the paper and the ink sheet subjected to printing when the paper and the ink sheet have been normally searched out, and finally decides the combination of the paper and the ink sheet subjected to printing after exchanging at least either the paper tray or the ink sheet cartridge and thereafter searching for the paper and the ink sheet again when the paper and the ink sheet have been abnormally searched out.

The printer according to the second aspect of the present invention, comprising the control portion finally deciding the combination of the paper and the ink sheet subjected to printing after searching for the paper and the ink sheet as hereinabove described, can change the combination, not yet finally decided, of the paper and the ink sheet subjected to printing if the same detects a shortage of the paper and/or the ink sheet when searching for the paper and the ink sheet in printing. Also when the paper and/or the ink sheet is in short supply in the search for the paper and the ink sheet in printing, therefore, the printer can perform printing by exchanging the paper and the ink sheet for a paper of another size and another ink sheet corresponding thereto respectively. Further, the control portion virtually decides the combination of the paper size corresponding to the paper tray detected by the paper tray detecting portion and the type of the ink sheet corresponding to the ink sheet cartridge detected by the cartridge detecting portion before searching for the paper and the ink sheet if the combination is a printable combination so that the printer can search for the paper and the ink sheet only in the case of the printable combination, not to search for a paper and an ink sheet of a nonprintable combination. In addition, the control portion finally decides the paper and the ink sheet subjected to printing after exchanging at least either the paper tray or the ink sheet and thereafter searching for the paper and the ink sheet again when the paper and the ink sheet have been abnormally searched out, whereby the printer can easily finally decide the combination of the exchanged paper and the exchanged ink sheet when the paper and the ink sheet are in short supply by exchanging the paper and the ink sheet for a paper of another size and another ink sheet corresponding thereto respectively. The paper tray detecting portion detects the paper size corresponding to the paper tray and the cartridge detecting portion detects the type of the ink sheet corresponding to the ink sheet cartridge every printing performed on a single paper so that the printer can easily continuously perform printing also when detecting a shortage of the paper and/or the ink sheet in an intermediate stage of printing on a plurality of papers by exchanging the paper tray and the ink sheet cartridge for those storing the paper and the ink sheet of the printable combination respectively. The control portion, determining whether or not the paper has been normally searched out on the basis of the result of detection of the paper detecting portion detecting the paper, can easily determine whether or not the paper has been normally searched out. Further, the control portion finally decides the combination of the paper and the ink sheet subjected to printing after searching for the paper and the ink sheet in response to the print instruction signal received from the image pickup apparatus, so that the printer can perform printing directly from the image pickup apparatus without through a personal computer or the like.

In the aforementioned printer according to the second aspect, the control portion preferably does not virtually decide the combination of the paper size corresponding to the paper tray detected by the paper tray detecting portion and the type of the ink sheet corresponding to the ink sheet cartridge detected by the cartridge detecting portion but posts abnormality to a user before searching for the paper and the ink sheet when the combination is not a printable combination. According to this structure, the user can easily recognize that the paper size and the type of the ink sheet abnormally correspond to each other (in a nonprintable combination) when mounting the paper tray and the ink sheet cartridge on the printer.

In the aforementioned printer according to the second aspect, the control portion preferably posts a shortage of the ink sheet to a user when abnormally searching for the ink sheet. According to this structure, the user can easily recognize that the ink sheet must be exchanged.

In the aforementioned printer according to the second aspect, the control portion preferably determines that the paper is abnormally searched out and posts a paper error to a user if the paper is in short supply and if the paper size determined when searching for the paper and the virtually decided paper size corresponding to the paper tray detected by the paper tray detecting portion do not correspond to each other. According to this structure, the user can easily recognize that the paper must be supplemented if the paper is in short supply, and that the paper currently stored in the paper tray must be exchanged for another paper of the printable size due to the size different from that of an originally printable paper.

The aforementioned printer according to the second aspect preferably further comprises a carrier roller whose rotational frequency is detected by the control portion, and the control portion preferably determines the paper size on the basis of a result of detection of the rotational frequency of the carrier roller required by the paper detecting portion for detecting the rear end of the paper after detecting the front end of the paper. According to this structure, the control portion can easily determine the size of the paper carried to the printer by calculating the distance between the front and rear ends of the paper from the rotational frequency of the carrier roller required by the paper detecting portion for detecting the rear end of the paper after detecting the front end of the paper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a thermal transfer printer according to the embodiment of the present invention is described with reference to FIGS. 1 to 8. This embodiment of the present invention is applied to the thermal transfer printer employed as an exemplary printer.

Figure 1:
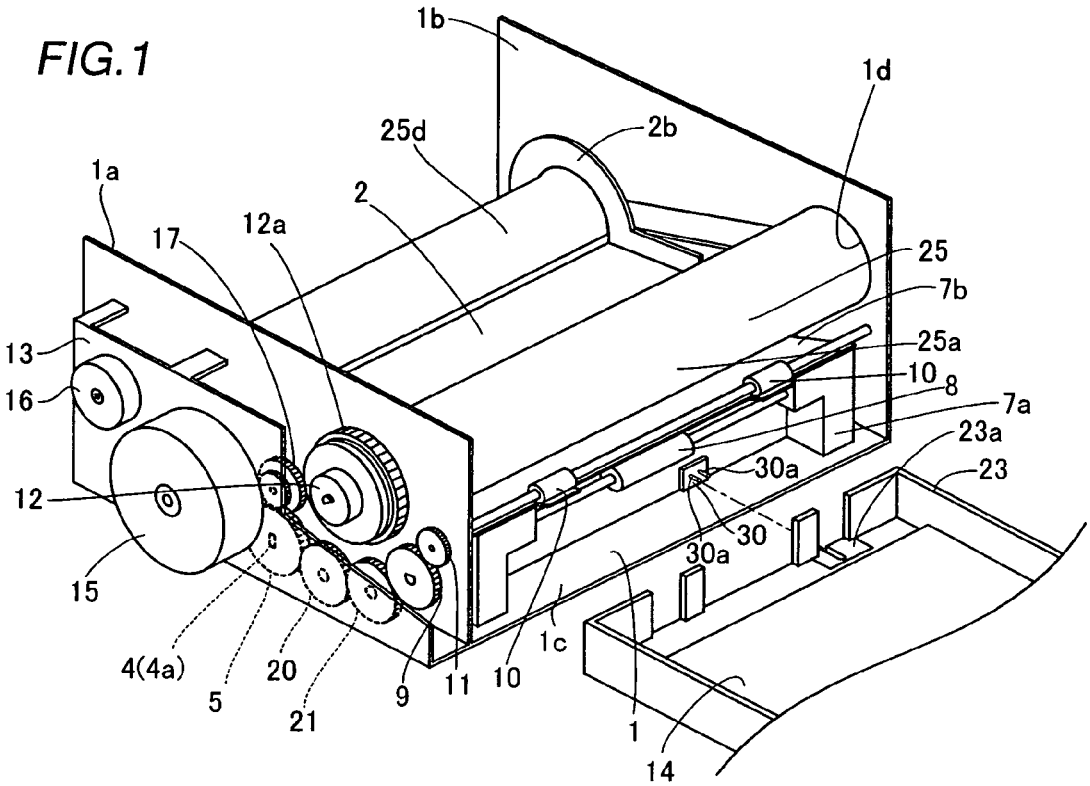
FIG. 1 is a perspective view showing the overall structure of a thermal transfer printer according to an embodiment of the present invention.
Figure 2:
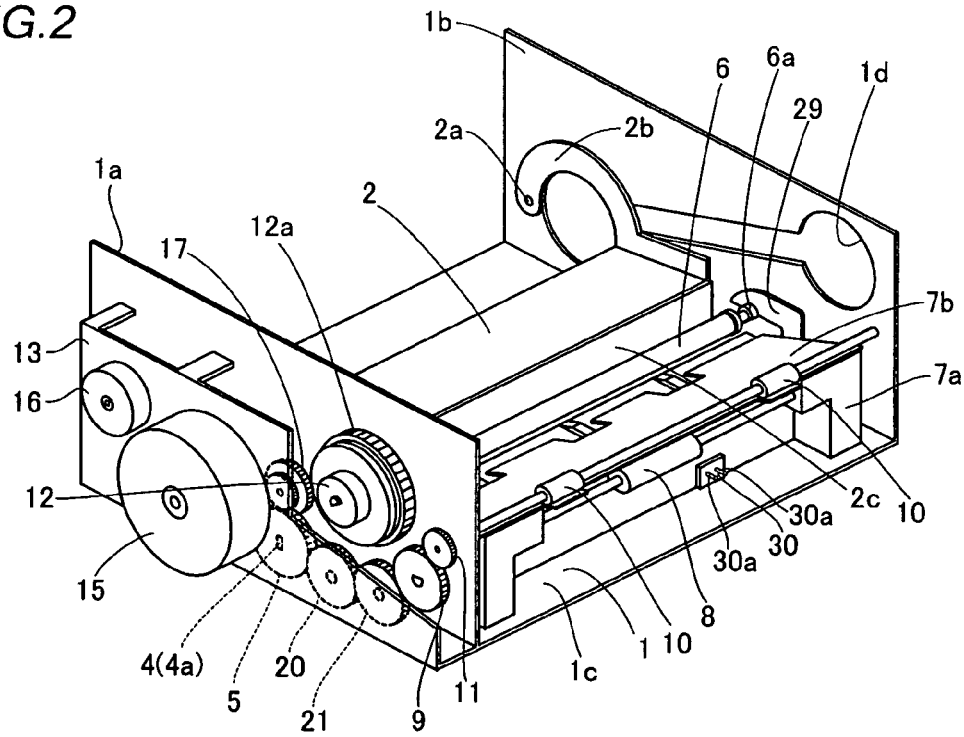
FIG. 2 is a perspective view of the thermal transfer printer according to the embodiment of the present invention shown in FIG. 1, from which an ink sheet cartridge and a paper tray are omitted.

As shown in FIGS. 1 and 2, the thermal transfer printer according to the embodiment of the present invention comprises a chassis 1 of a metal, a print head 2 for printing, a platen roller 3 (see FIG. 8) opposed to the print head 2, a feed roller 4 (see FIG. 8) of a metal, a feed roller gear 5, a press roller 6 (see FIG. 8) of a metal pressing the feed roller 4 with prescribed pressing force, a lower paper guide 7*a* of resin, an upper paper guide 7*b* of resin, a paper feed roller 8 of rubber, a paper feed roller gear 9, a paper discharge roller 10 of rubber, a paper discharge roller gear 11, an ink sheet take-up reel 12, a motor bracket 13, a motor 15 for carrying papers 14 (see FIG. 1), another motor 16 rotating the print head 2, a swingable swing gear 17, a plurality of intermediate gears 18 to 21 (see FIG. 4), a circuit portion 22 (see FIG. 3) controlling operations of the thermal transfer printer, a paper tray 23 (see FIG. 1) provided in correspondence to each of a plurality of sizes of the papers 14 (see FIG. 1) and an ink sheet cartridge 25 (see FIG. 1) provided in correspondence to an ink sheet 24 (see FIG. 8) corresponding to the sizes of the plurality of papers 14. The feed roller 4 is an example of the "carrier roller" in the present invention.

Figure 3:
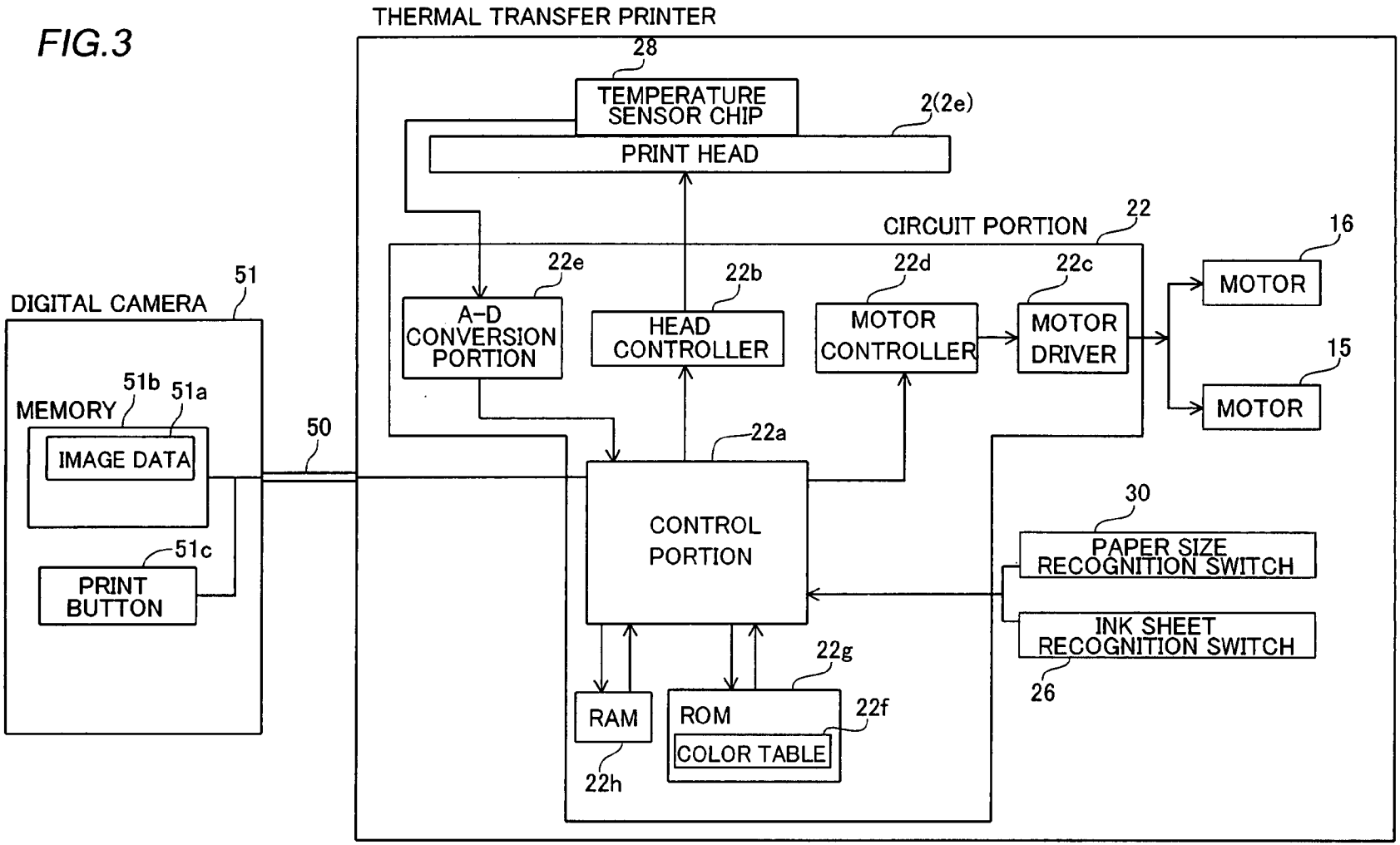
FIG. 3 is a block diagram showing the circuit structure of the thermal transfer printer according to the embodiment shown in FIG. 1.

According to this embodiment, a digital camera 51 is connected to the thermal transfer printer through a cable 50 such as a USB cable, as shown in FIG. 3. The digital camera 51 is an example of the "image pickup apparatus" in the present invention. This digital camera 51 is provided with a memory 51*b* for storing image data 51*a* etc. and a print button 51*c* pressed by a user for transmitting a print instruction signal to the thermal transfer printer.

Figure 5:
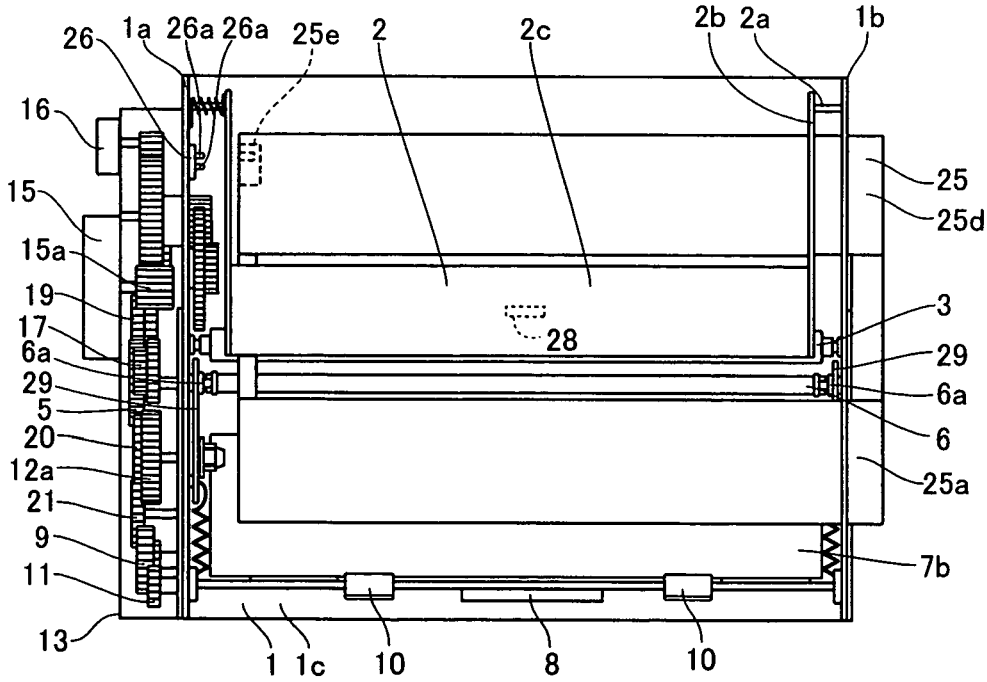
FIG. 5 is a plan view of the thermal transfer printer according to the embodiment shown in FIG. 1.

As shown in FIGS. 1 and 2, the chassis 1 has a first side surface 1*a*, a second side surface 1*b* and a bottom surface 1*c*. The aforementioned motor bracket 13 is mounted on the first side surface 1*a* of the chassis 1. An ink sheet recognition switch 26 having two switch portions 26*a* is provided inside the first side surface 1*a* of the chassis 1, as shown in FIG. 5. The ink sheet recognition switch 26 is an example of the "cartridge detecting portion" in the present invention. The second side surface 1*b* of the chassis 1 is provided with a receiving hole 1*d* for receiving the ink sheet cartridge 25, as shown in FIGS. 1 and 2. The bottom surface 1*c* of the chassis 1 is provided with paper sensors 27*a* and 27*b* (see FIG. 8) for detecting front and rear ends 14*a* and 14*b* (see FIG. 8) of each paper 14. The paper sensors 27*a* and 27*b* are examples of the "paper detecting portion" in the present invention.

Figure 6:
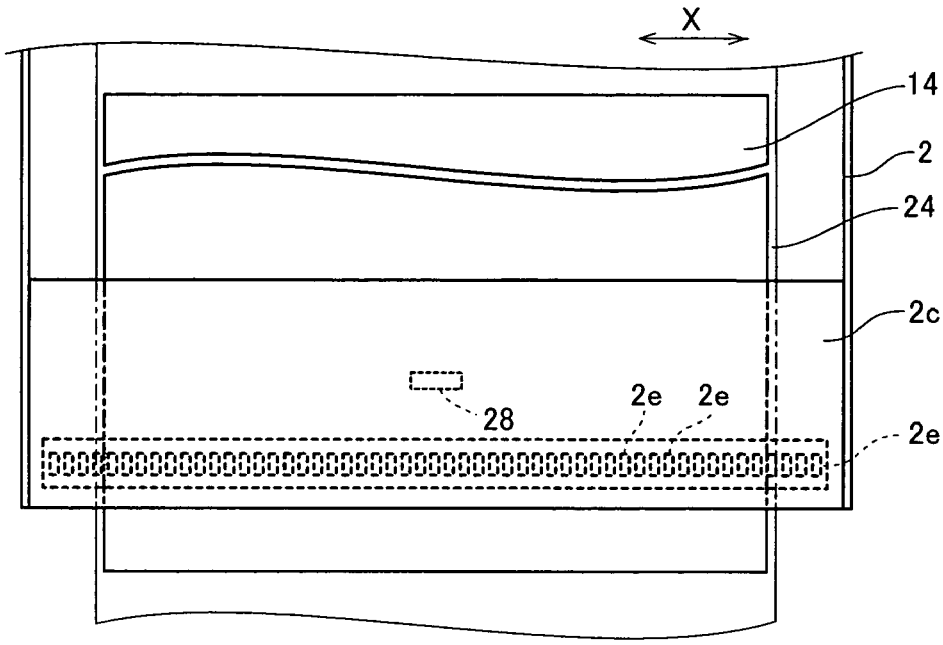
FIG. 6 illustrates a print head of the thermal transfer printer according to the embodiment shown in FIG. 1 in detail.
Figure 8:
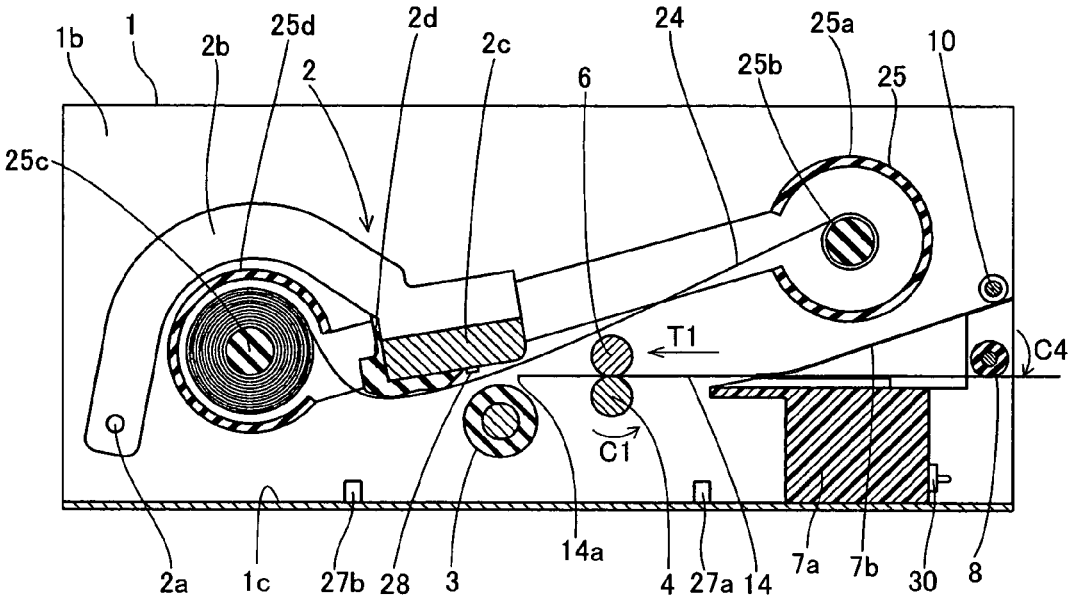
FIG. 8 is a sectional view of the thermal transfer printer according to the embodiment shown in FIG. 1.

As shown in FIG. 8, the print head 2 includes a support shaft 2*a*, an arm portion 2*b*, a head portion 2*c* and a head cover 2*d* of resin mounted on the head portion 2*c*. This print head 2 is mounted inside both side surfaces 1*a* and 1*b* of the chassis 1 to be rotatable about the support shaft 2*a*, as shown in FIG. 2. A plurality of heating elements 2*e* generating heat upon application of a voltage pulse are aligned on the head portion 2*c* of the print head 2 at prescribed intervals along the cross direction (direction X) of the papers 14, as shown in FIG. 6. The heating elements 2*e* are so constructed that each heating element 2*e* forms a dot in printing. A temperature sensor chip 28 for detecting the temperature around the heating elements 2*e* of the print head 2 is provided in the vicinity of the heating elements 2*e* provided on the bottom surface of the print head 2.

Figure 4:
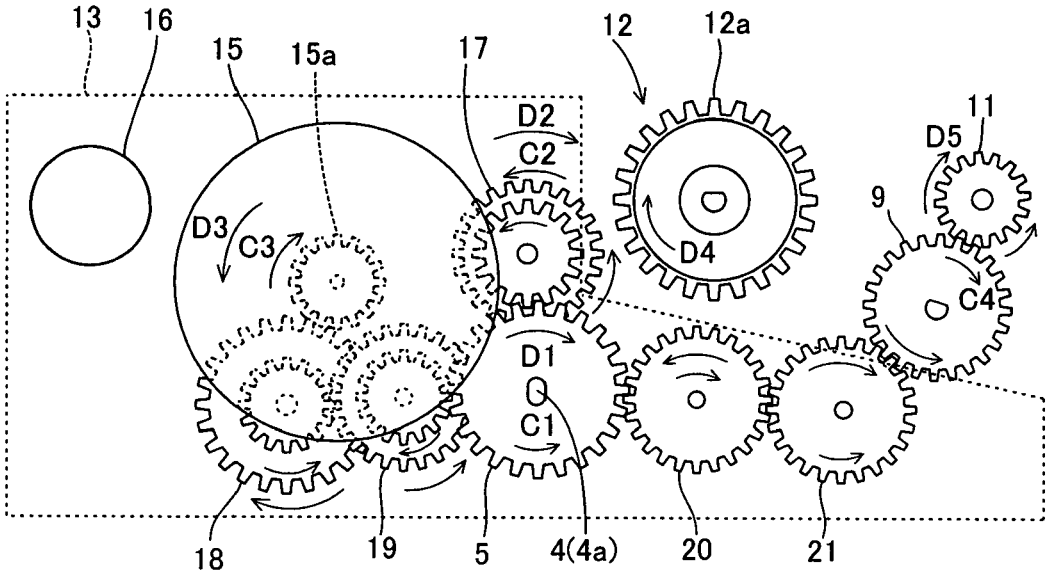
FIG. 4 is a side elevational view showing a motor and gears of the thermal transfer printer according to the embodiment shown in FIG. 1.

The platen roller 3 (see FIG. 5) is rotatably arranged inside both side surfaces 1*a* and 1*b* of the chassis 1. The feed roller 4 has a feed roller gear insert portion 4*a* inserted into the feed roller gear 5, as shown in FIG. 4. A feed roller bearing (not shown) mounted on the chassis 1 rotatably supports this feed roller 4. A press roller gear 6*a* rotatably supports the press roller 6, as shown in FIGS. 2 and 5. This press roller bearing 6*a* is mounted on a bearing support plate 29. The bearing support plate 29 is arranged inside both side surfaces 1*a* and 1*b* of the chassis 1, to press the press roller 6 against the feed roller 4 (see FIG. 8) with urging force of a spring (not shown).

As shown in FIG. 4, a motor gear 15*a* is mounted on a shaft portion of the motor 15 mounted on the motor bracket 3. The motor 15 functions as a drive source for driving the gear portion 12*a* of the ink sheet take-up reel 12, the paper feed roller gear 9, the paper discharge roller gear 11 and the feed roller 5. The other motor 16 functions as a drive source for a pressing member (not shown) pressing the upper surface of the print head 2 (see FIG. 8), in order to press the print head 2 against the platen roller 3 (see FIG. 8).

As shown in FIG. 8, the ink sheet take-up reel 12 (see FIG. 4) is so formed as to engage with a take-up bobbin 25*b* rotatably arranged in a take-up portion 25*a* of the ink sheet cartridge 25 thereby taking up the ink sheet 24 on the take-up bobbin 25*b*. The gear portion 12*a* of the ink sheet take-up reel 12 is so arranged as to engage with the swing gear 17 upon swinging thereof, as shown in FIG. 4.

The lower paper guide 7*a* is set in the vicinity of the feed roller 4 (see FIG. 8) and the press roller 6, as shown in FIGS. 2 and 8. This lower paper guide 7*a* is provided with a paper size recognition switch 30 having two switch portions 30*a*, as shown in FIGS. 1 and 2. The paper size recognition switch 30 is an example of the "paper tray detecting portion" in the present invention. The upper paper guide 7*b* is mounted on an upper portion of the lower paper guide 7*a*, as shown in FIG. 8. This upper paper guide 7*b* guides each paper 14 to a paper feed path toward a print portion through the lower surface thereof in paper feeding, while guiding each paper 14 to a paper discharge path through the upper surface thereof in paper discharge.

Figure 7:
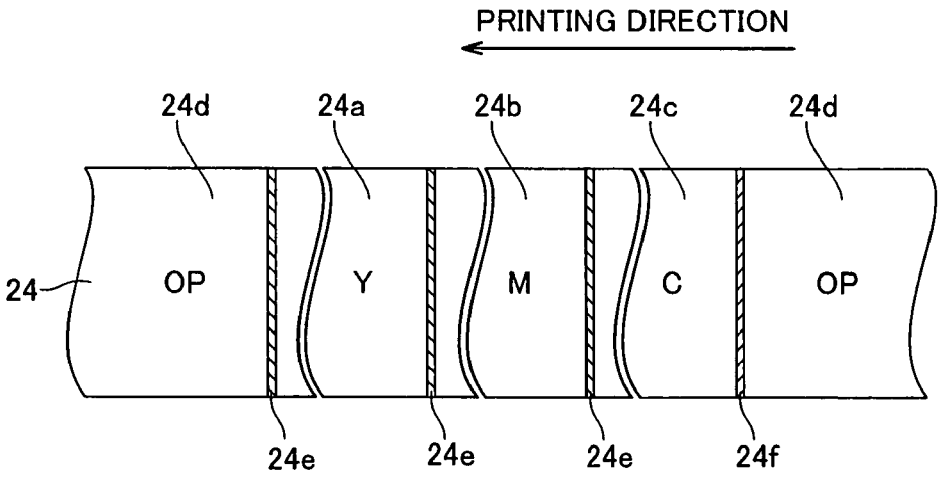
FIG. 7 is a diagram for illustrating an ink sheet of the thermal transfer printer according to the embodiment shown in FIG. 1.

The ink sheet cartridge 25 is provided with a feed portion 25*d* having a feed bobbin 25*c*, wound with the ink sheet 24, rotatably arranged therein. As shown in FIG. 7, the ink sheet 24 has three color sheets, i.e., a Y (yellow) printing sheet 24*a*, an M (magenta) printing sheet 24*b* and a C (cyan) printing sheet 24*c*, and transparent OP (overcoat) sheets 24*d* for protecting a printed surface of each paper 14. Identification portions 24*e* recognized by a sheet search sensor (not shown) are provided between one of the OP (overcoat) sheets 24*d* and the Y (yellow) printing sheet 24*a*, between the Y (yellow) printing sheet 24*a* and the M (magenta) printing sheet 24*b* and between the M (magenta) printing sheet 24*b* and the C (cyan) printing sheet 24*c*. A further identification portion 24*f* recognized by the sheet search sensor (not shown) is provided between the C (cyan) printing sheet 24*c* and the other one of the OP (overcoat) sheets 24*d*.

According to this embodiment, a contact portion 25*e* having one or two recess portions is provided on an end of the feed portion 25*d* of the ink sheet cartridge 25, as shown in FIG. 5. The contact portion 25*e* is so provided with the recess portion(s) as to correspond to one or two switch portions 26*a* of the ink sheet recognition switch 26. When the ink sheet cartridge 25 is mounted on the thermal transfer printer, therefore, the switch portion(s) 26*a* of the ink sheet recognition switch 26 corresponding to the recess portion(s) does not enter an input state, so that the types of the ink sheet cartridge 25 and the ink sheet 24 are recognized through the combination of input and non-input switch portions 26*a*. More specifically, the thermal transfer printer according to this embodiment corresponds to three types of paper sizes consisting of a postcard size, a large photograph size and a card size, and has four states including a state where the ink sheet cartridge 25 is not mounted on the thermal transfer printer (neither of the two switch portions 26*a* of the ink sheet recognition switch 26 are input). The ink sheet recognition switch 26 can identify the four states by combinations ("0,0", "0,1", "1,0" and "1,1") of input and non-input states ("0" and "1", for example) of the two switch portions 26*a*. Thus, the ink sheet recognition switch 26 can identify the types of the mounted ink sheet cartridge 25 and the ink sheet 24.

According to this embodiment, another contact portion 23*a* having one or two recess portions is provided on an end surface of the paper tray 23, as shown in FIG. 1. The contact portion 23*a* is so provided with the recess portion(s) as to correspond to one or two switch portions 30*a* of the paper size recognition switch 30. When the paper tray 23 is mounted on the thermal transfer printer, therefore, the switch portion(s) 30*a* of the paper size recognition switch 30 corresponding to the recess portion(s) does not enter an input state, so that the type of the paper tray 23 and the size of each paper 14 are recognized through the combination of input and non-input switch portions 30*a*. More specifically, the thermal transfer printer according to this embodiment corresponds to the three types of paper sizes consisting of the postcard size, the large photograph size and the card size as described above, and has four states including a state where the paper tray 23 is not mounted on the thermal transfer printer (neither of the two switch portions 30*a* of the paper size recognition switch 30 are input). The paper size recognition switch 30 can identify the four states by combinations ("0,0", "0,1", "1,0" and "1,1") of input and non-input states ("0" and "1", for example) of the two switch portions 30*a*. Thus, the paper size recognition switch 30 can identify the type of the paper tray 23 and the size of each paper 14.

As shown in FIG. 3, the circuit portion 22 includes a control portion 22*a* controlling printing operations of the thermal transfer printer, a head controller 22*b* controlling the temperatures of the heating elements 2*e* of the print head 22, a motor driver 22*c*, a motor controller 22*d*, an A-D conversion portion 22*e*, a ROM 22*g* having a color table 22*f* and a RAM 22*h* for developing the color table 22*f*. The motor controller 22*d* has a function of controlling the motors 15 and 16 through the motor driver 22*c*. The head controller 22*b* has a function of controlling the temperatures of the heating elements 2*e* of the print head 2 by applying a voltage pulse to the heating elements 2*e*. The A-D conversion portion 22*e* has a function of converting an analog voltage value received from the temperature sensor chip 28 provided in the vicinity of the heating elements 2*e* of the print head 2 to a digital voltage value.

The printing operations of the thermal transfer printer according to this embodiment with the digital camera 51 are now described with reference to FIGS. 2 to 4, 6, 7 and 9 to 11.

Figure 11:
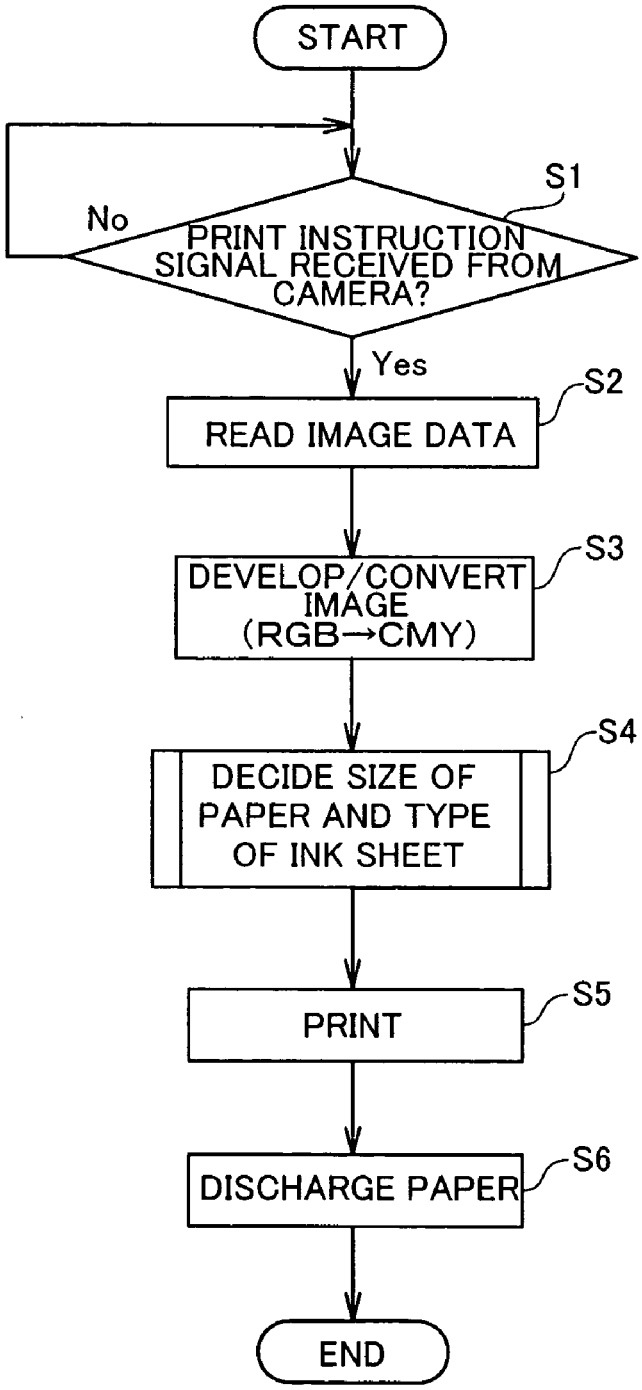
FIG. 11 is a flow chart for illustrating a printing operation with a digital camera in the thermal transfer printer according to the embodiment shown in FIG. 1.

At a step S1 shown in FIG. 11, the control portion 22*a* (see FIG. 3) determines whether or not a print instruction signal is received from the digital camera 51 (see FIG. 3) through the cable 50 (see FIG. 3). When determining that no print instruction signal is received at the step S1, the control portion 22*a* repeats this determination until the print instruction signal is received. When the control portion 22*a* determines that the print instruction signal is received, on the other hand, the process advances to a step S2. At the step S2, the control portion 22*a* reads the image data 51*a* from the digital camera 51 through the cable 50 (see FIG. 3).

At a step S3, the control portion 22*a* develops the read image data 51*a* on the RAM 22*h* (see FIG. 3), and thereafter converts the image data 51*a* from RGB data to CMY data. The RGB data is constituted of the three primary colors of light (R: red, G: green and B: blue), while the CMY data is constituted of the three primary colors (C: cyan, M: magenta and Y: yellow).

At a step S4, the control portion 22*a* decides the size of the paper 14 and the type of the ink sheet 24 used for printing. The decision of the size of the paper 14 and the type of the ink sheet 24 is described later in detail.

Figure 9:
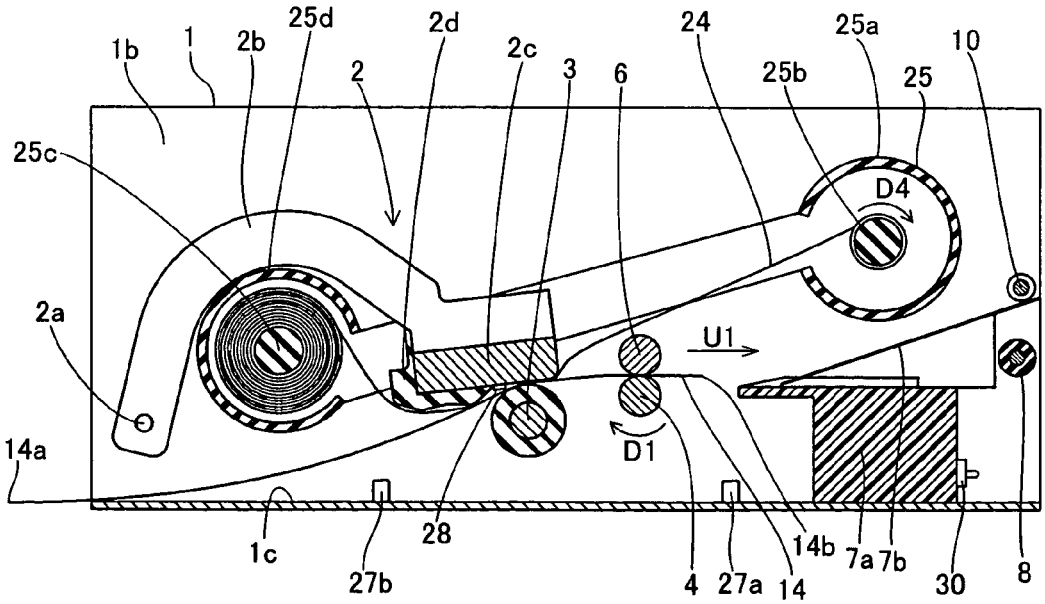
FIGS. 9 and 10 are sectional views for illustrating operations of the thermal transfer printer according to the embodiment shown in FIG. 1.

At a step S5, the control portion 22*a* drives the motor 16 (see FIG. 2) through the motor controller 22*d* (see FIG. 3) and the motor driver 22*c* (see FIG. 3). The motor 16 (see FIG. 2) rotates the pressing member (not shown), thereby rotating the head portion 2*c* of the print head 2 toward the platen roller 3 as shown in FIG. 9. Thus, the heating elements 2*e* (see FIG. 6) of the print head 2 press the platen roller 3 through the ink sheet 24 and the paper 14.

As shown in FIG. 4, the motor gear 15*a* mounted on the motor 15 rotates along arrow D3 following the driven motor 15, for rotating the feed roller gear 5 along arrow D1 through the intermediate gears 18 and 19. Thus, the feed roller 4 rotates along arrow D1 in FIG. 9 following the rotation of the feed roller gear 5 along arrow D1, thereby discharging the paper 14 in a paper discharge direction (along arrow U1 in FIG. 9). Further, the swingable swing gear 17 swings along arrow D2, to engage with the gear portion 12*a* of the ink sheet take-up reel 12. Thus, the gear portion 12*a* of the ink sheet take-up reel 12 (see FIG. 4) rotates along arrow D4, so that the take-up bobbin 25*b* takes up the ink sheet 24 wound on the feed bobbin 25*c*.

At this time, the paper 14 is carried in the paper discharge direction (along arrow U1) while the take-up bobbin 25*b* takes up the ink sheet 25, so that the heating elements 2*e* of the print head 2 print ink from the Y (yellow) printing sheet 24*a* (see FIG. 7) onto the paper 14. When the ink is completely printed from the Y (yellow) printing sheet 24*a*, the upper paper guide 7*b* guides the paper 14 to a position carriable by the paper discharge roller 10, as shown in FIG. 10.

Then, the motor 16 (see FIG. 4) rotates the pressing member (not shown) upward, for rotating the head portion 2*c* of the print head 2 and separating the same from the platen roller 3. The sheet search sensor (not shown) recognizes the identification portion 24*e* (see FIG. 7) provided on the head of the M (magenta) printing sheet 24*b* (see FIG. 6), thereby searching for the M (magenta) printing sheet 24*b*. As shown in FIG. 4, the motor gear 15*a* mounted on the motor 15 rotates along arrow C3 following the driven motor 15, for rotating the feed roller gear 5 along arrow C1 through the intermediate gears 18 and 19. Thus, the feed roller 4 rotates along arrow C1 as shown in FIG. 10, for carrying the paper 14 to a print starting position along with the press roller 6. The thermal transfer printer prints ink from the M (magenta) printing sheet 24*b* onto the paper 14 through operations similar to the above. Thereafter the thermal transfer printer prints ink from the C (cyan) printing sheet 24*c* (see FIG. 7) onto the paper 14 and then prints ink from the transparent OP (overcoat) sheets 24*d* (see FIG. 7), for completing the printing operations on the paper 14. According to this embodiment, the thermal transfer printer repeats the printing operations in the aforementioned steps S1 to S5 every paper 14.

Figure 10:
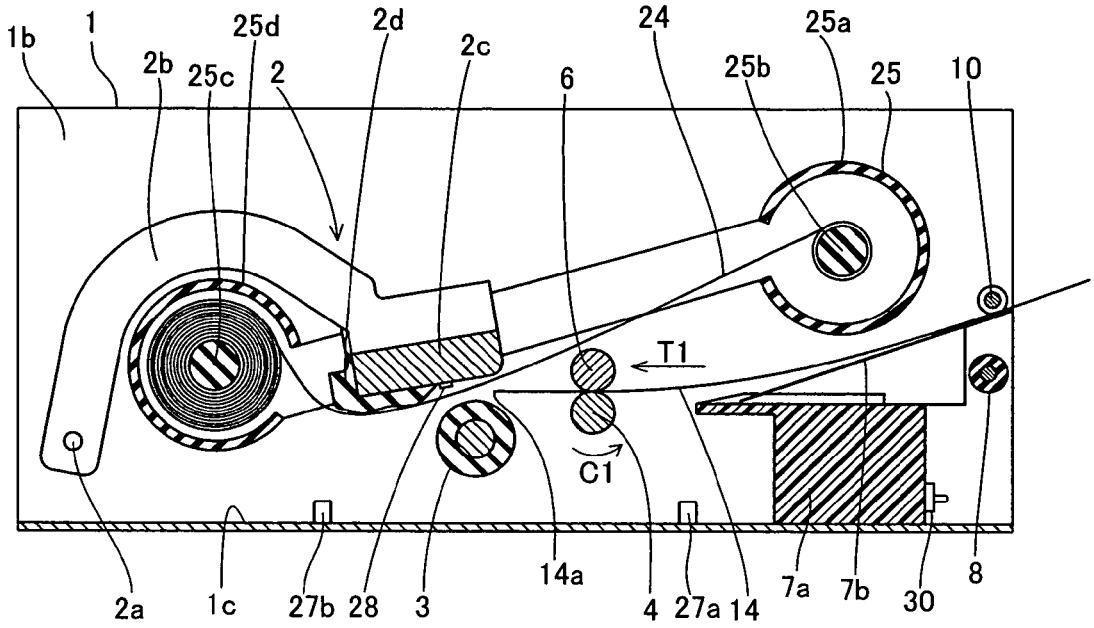

At a step S6 shown in FIG. 11, the upper paper guide 7*b* guides the printed paper 14 so that the paper discharge roller 10 discharges the same, as shown in FIG. 10. At this time, the motor 15 (see FIG. 4) and the respective gears operate similarly to the case of carrying the paper 14 in the paper discharge direction (along arrow U1 in FIG. 9) in printing.

Figure 12:
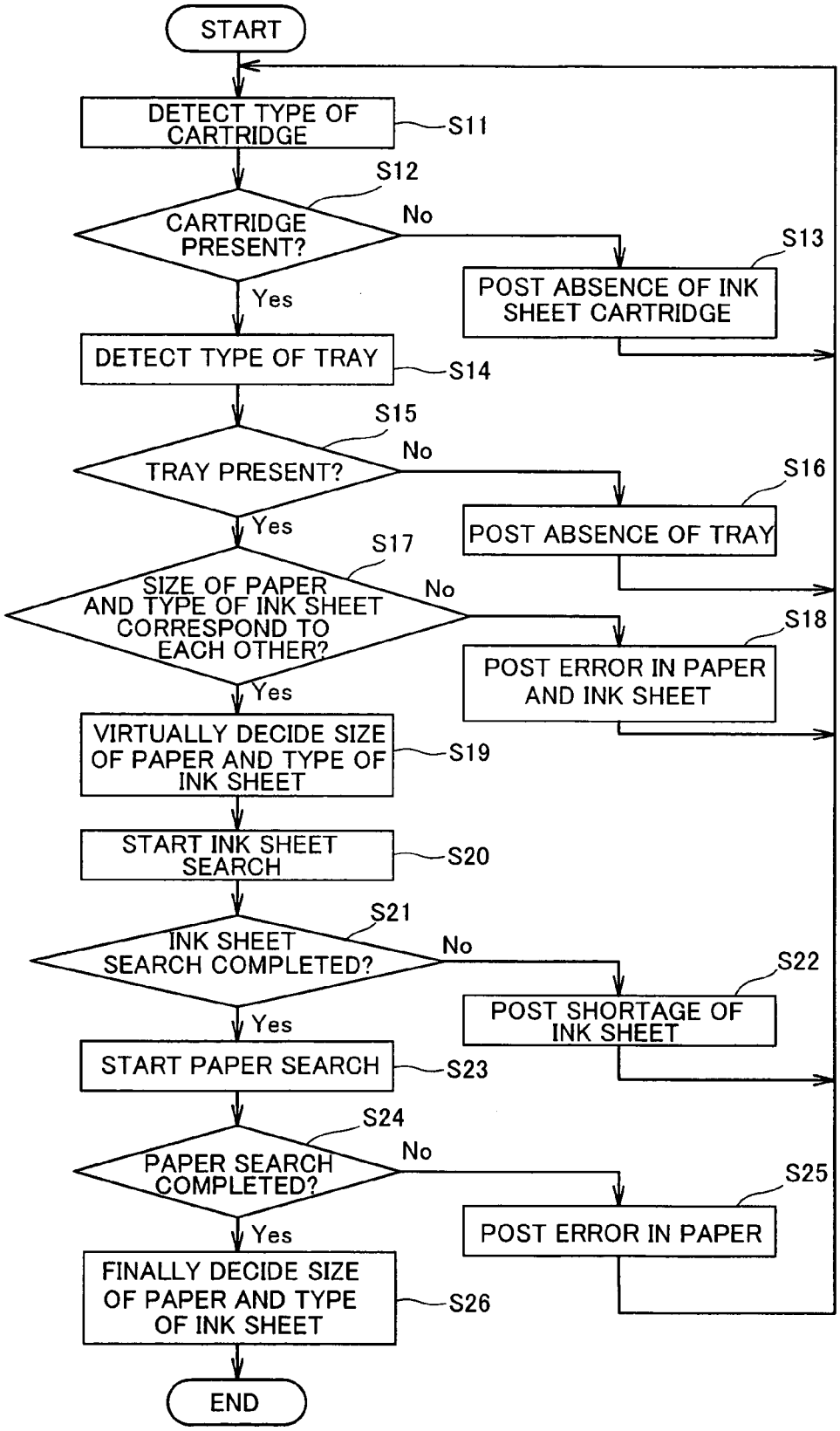
FIG. 12 is a flow chart for illustrating an operation of deciding the paper size and the type of the ink sheet in the thermal transfer printer according to the embodiment shown in FIG. 1 in detail.

FIG. 12 is a flow chart showing the decision of the size of the paper 14 and the type of the ink sheet 24 in the thermal transfer printer according to the embodiment shown in FIG. 11. The decision of the size of the paper 14 and the type of the ink sheet 24 at the step S4 in FIG. 11 is now described in detail with reference to FIGS. 1, 3, 4, 7 and 8.

At a step S11 in FIG. 12, the ink sheet recognition switch 26 (see FIG. 3) detects the types of the ink sheet cartridge 25 (see FIG. 8) and the ink sheet 24 (see FIG. 8) mounted on the thermal transfer printer. More specifically, the ink sheet recognition switch 26 detects whether the types of the ink sheet cartridge 25 and the ink sheet 24 mounted on the thermal transfer printer correspond to the post card size, the large photograph size or the card size, or whether the ink sheet cartridge 25 and the ink sheet 24 are not mounted. At a step S12, the control portion 22*a* (see FIG. 3) determines whether or not the ink sheet cartridge 25 is mounted on the thermal transfer printer. When determining that no ink sheet cartridge 25 is mounted on the thermal transfer printer at the step S12, the control portion 22*a* posts "absence of ink sheet cartridge" to the digital camera 51 at a step S13, and the process returns to the step S11. Thus, the user recognizes that no ink sheet cartridge 25 is mounted on the thermal transfer printer, for mounting the ink sheet cartridge 25 on the thermal transfer printer. When the control portion 22*a* determines that the ink sheet cartridge 25 is mounted on the thermal transfer printer at the step S12, on the other hand, the process advances to a step S14.

At the step S14, the paper size recognition switch 30 (see FIG. 3) detects the type of the paper tray 23 (see FIG. 1) mounted on the thermal transfer printer and the size of the paper 14. More specifically, the paper size recognition switch 30 detects whether the type of the paper tray 23 and the size of the paper 14 correspond to the post card size, the large photograph size or the card size, or whether the paper tray 23 and the paper 14 are not mounted. At a step S15, the control portion 22*a* determines whether or not the paper tray 23 is mounted on the thermal transfer printer. When determining that no paper tray 23 is mounted on the thermal transfer printer, the control portion 22*a* posts "absence of paper tray" to the digital camera 51, and the process returns to the step S11. Thus, the user recognizes that no paper tray 23 is mounted on the thermal transfer printer, for mounting the paper tray 23 on the thermal transfer printer. When the control portion 22*a* determines that the paper tray 23 is mounted on the thermal transfer printer at the step S15, on the other hand, the process advances to a step S17.

At the step S17, the control portion 22*a* determines whether or not the type of the ink sheet 24 detected at the step S11 and the size of the paper 14 detected at the step S14 correspond to each other. When determining that the type of the ink sheet 24 detected at the step S11 and the size of the paper 14 detected at the step S14 do not correspond to each other at the step S17, the control portion 22*a* posts "error in paper and ink sheet" (abnormality) to the digital camera 51, and the process returns to the step S11. Thus, the user recognizes that the ink sheet 24 of the ink sheet cartridge 25 mounted on the thermal transfer printer and the paper 14 in the paper tray 23 do not correspond to each other. In this case, the user exchanges at least either the ink sheet cartridge 25 or the paper tray 23, so that the ink sheet 24 of the ink sheet cartridge 25 and the paper 14 of the paper tray 23 correspond to each other. When the control portion 22*a* determines that the type of the ink sheet 24 detected at the step S11 and the size of the paper 14 detected at the step S14 correspond to each other at the step S17, on the other hand, the process advances to a step S19. At the step S19, the control portion 22*a* virtually decides the type of the ink sheet 24 detected at the step S11 and the size of the paper 14 detected at the step S14 as the type of the ink sheet 24 and the size of the paper 14 subjected to printing.

At a step S20, the control portion 22*a* searches for the ink sheet 24 with the motor 15. More specifically, the motor 15 rotates the gear portion 12*a* of the ink sheet take-up reel 12 for carrying the ink sheet 24, so that the sheet search sensor (not shown) detects the identification portion 24*e* provided on the head of the Y (yellow) printing sheet 24*a* (see FIG. 7). Thus, the control portion 22*a* searches for the ink sheet 24. At a step S21, the control portion 22*a* determines whether or not the search for the ink sheet 24 is completed (normally performed). If the ink sheet 24 is in short supply (absent) at this time, the search for the ink sheet 24 is uncompleted (abnormally performed). Therefore, the control portion 22*a* determines that the search for the ink sheet 24 is not yet completed (abnormally performed) at the step S21, and the process advances to a step S22. At the step S22, the control portion 22*a* posts "shortage of ink sheet" to the digital camera 51, and the process returns to the step S11. Thus, the user recognizes that the ink sheet 24 is in short supply. When the control portion 22*a* determines that the search for the ink sheet 24 is completed (normally performed) at the step S21, on the other hand, the process advances to a step S23.

At the step S23, the control portion 22*a* searches for the paper 14 with the motor 15. More specifically, the motor gear 15*a* mounted on the motor 15 rotates along arrow C3 following the driven motor 15, for rotating the feed roller gear 5 along arrow C1 through the intermediate gears 18 and 19, as shown in FIG. 4. Following this rotation of the feed roller gear 5 along arrow C1, the paper feed roller gear 9 rotates along arrow C4 through the intermediate gears 20 and 21. Thus, the paper feed roller 8 also rotates along arrow C4 following this rotation of the paper feed roller gear 9 as shown in FIG. 8, thereby carrying the paper 14 in contact with the lower surface of the paper feed roller 8 in a paper feed direction (along arrow T1). At this time, the paper sensor 27*a* detects the forward end 14*a* of the paper 14 in the paper feed direction, thereby recognizing that the paper tray 23 stores the paper 14. If the paper tray 23 stores no paper 14, the paper sensor 27*a* detects no front end 14*a* of the paper 14 in the paper feed direction, so that the control portion 22*a* determines a shortage of the paper 14. The paper sensor 27*b* also detects the front end 14*a* of the paper 14 carried in the paper feed direction. Thereafter the lower paper guide 7*a* guides the paper 14 carried by the paper feed roller 8 while passing through the paper sensor 27*b* to progress along the paper feed direction, so that the feed roller 4 and the press roller 6 carry the paper 14 to the printing start position shown in FIG. 9. The paper sensor 27*a* detects the rear end 14*b* of the paper 14, carried to the printing start position, in the paper feed direction. At this time, the control portion 22*a* calculates the distance between the front and rear ends 14*a* and 14*b* of the paper 14 from the rotational frequency of the feed roller 4 between the detection of the front end 14*a* of the paper 14 and the detection of the rear end 14*b* thereof, thereby recognizing the size of the paper 14.

At a step S24, the control portion 22*a* determines whether or not the search for the paper 14 is completed. More specifically, the search for the paper 14 is uncompleted (abnormally performed) when the paper 14 is in short supply or the size of the carried paper 14 and the size of the paper 14 virtually decided at the step S19 do not correspond to each other, and hence the control portion 22*a* determines that the search for the paper 14 is not yet completed (abnormally performed), so that the process advances to a step S25. At the step S25, the control portion 22*a* posts "error in paper" to the digital camera 51, and the process returns to the step S11. Thus, the user recognizes that the paper 14 is in short supply, or that the paper 24 and the paper tray 26 do not correspond to each other. If the paper 14 is in short supply and no paper 14 of the size virtually decided at the step S19 is reserved but a paper 14 of a size different from that virtually decided at the step S19 and an ink sheet 24 corresponding to this paper 14 are reserved, the user substitutes the paper 14 and the ink sheet 24 for those mounted on the thermal transfer printer, so that the control portion 22*a* can perform printing from the step S11 again.

When the control portion 22*a* determines that the search for the paper 14 is completed (normally performed) at the step S24, on the other hand, the process advances to a step S26. At the step S26, the control portion 22*a* finally decides the size of the paper 14 and the type of the ink sheet 24 subjected to printing, to end the process.

According to this embodiment, as hereinabove described, the control portion 22*a* searches for the paper 14 and the ink sheet 24 and finally decides the size of the paper 14 and the type of the ink sheet 24 subjected to printing when the searches for the paper 14 and the ink sheet 24 are completed (normally performed), so that the size of the paper 14 and the type of the ink sheet 24 subjected to printing are not yet finally decided and the user can change the size of the paper 14 and the type of the ink sheet 24 subjected to printing when the paper 14 or the ink sheet 24 is in short supply in the search for the paper 14 or the ink sheet 24. If the paper 14 or the ink sheet 24 is in short supply when the control portion 22*a* searches for the paper 14 or the ink sheet 24 subjected to printing, therefore, the thermal transfer printer can perform printing with the paper 14 of another size and the ink sheet 24 corresponding to this paper 14 as reserved.

According to this embodiment, the control portion 22*a* virtually decides a combination of the size of the paper 14 corresponding to the paper tray 23 detected by the paper size recognition switch 30 and the type of the ink sheet 24 corresponding to the ink sheet cartridge 25 detected by the ink sheet recognition switch 26 before searching for the paper 14 and the ink sheet 24 when the combination is a printable combination in order to search for the paper 14 and the ink sheet 24 only in the case of the printable combination, not to search for the paper 14 and the ink sheet 24 of a nonprintable combination.

According to this embodiment, the control portion 22*a* is so formed as not to virtually decide a combination of the size of the paper 14 corresponding to the paper tray 23 detected by the paper size detection switch 30 and the type of the ink sheet 24 corresponding to the ink sheet cartridge 25 detected by the ink sheet recognition switch 26 but to post "error in paper and ink sheet" (abnormality) to the user before searching for the paper 14 and the ink sheet 24 when the combination is a nonprintable combination, so that the user can easily recognize that the size of the paper 14 and the type of the ink sheet 24 do not normally correspond to each other (in a nonprintable combination) when mounting the paper tray 23 and the ink sheet cartridge 25 on the thermal transfer printer.

According to this embodiment, the control portion 22*a* is so formed as to post "shortage of ink sheet" to the user if the search for the ink sheet 24 is not normally performed, so that the user can easily recognize that the ink sheet 24 must be exchanged.

According to this embodiment, the control portion 22*a* is so formed as to determine that the paper 14 is not normally searched out and posts "paper error" to the user when the paper 14 is in short supply and the size of the paper 14 determined in the search therefor and the virtually decided size of the paper 14 corresponding to the paper tray 23 detected by the paper recognition switch 30 do not correspond to each other, whereby the user can easily recognize that the paper 14 must be supplemented when the paper 14 is in short supply, or that the current paper 14 must be exchanged for another paper 14 of the printable size due to the size different from that of an originally printable paper 14.

According to this embodiment, the paper size recognition switch 30 detects the size of the paper 14 corresponding to the paper tray 23 while the ink sheet recognition switch 26 detects the type of the ink sheet 24 corresponding to the ink sheet cartridge 25 every time the thermal transfer performs printing on a single paper 14, whereby the thermal transfer printer can easily continuously perform printing by exchanging the paper tray 23 and the ink sheet cartridge 25 for those storing the paper 14 and the ink sheet 24 of a printable combination also when the paper 14 and the ink sheet 24 are in short supply in an intermediate stage of printing on a plurality of papers 14.

According to this embodiment, the paper sensors 27*a* and 27*b* detect the front and rear ends 14*a* and 14*b* of the paper 14 for ascertaining the size of the paper 14, so that the control portion 22*a* can determine whether or not the paper 14 and the paper tray 23 correspond to each other. Thus, the control portion 22*a* can easily determine whether or not the search for the paper 14 is completed (normally performed).

According to this embodiment, the thermal transfer printer further comprises the feed roller 4 whose rotational frequency is detected by the control portion 22*a* so that the control portion 22*a* determines the size of the paper 14 on the basis of the rotational frequency of the feed roller 4 required by the paper sensor 27*a* for detecting the rear end 14*b* of the paper 14 after detecting the front end 14*a* thereof, whereby the control portion 22*a* can calculate the distance between the front and rear ends 14*a* and 14*b* of the paper 14 from the rotational frequency required by the paper sensor 27*a* for detecting the rear end 14*b* of the paper 14 after detecting the front end 14*a* thereof. Thus, the control portion 22*a* can easily determine the size of the paper 14 carried to the thermal transfer printer.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary printer comprising the paper tray 23 and the ink sheet cartridge 25, the present invention is not restricted to this but is also applicable to a printer other than the thermal transfer printer so far as the same comprises a paper tray and an ink sheet cartridge similar to those of the aforementioned embodiment.

While the digital camera 51 (electronic still camera) is employed as an exemplary image pickup apparatus in the aforementioned embodiment, the present invention is not restricted to this but an image pickup apparatus other than the digital camera may alternatively be employed.

While a plurality of types of ink sheet cartridges 25 are provided in correspondence to a plurality of types of paper trays 23 respectively in the aforementioned embodiment, the present invention is not restricted to this but a single type of ink sheet cartridge 25 may alternatively be employed in correspondence to a plurality of types of paper trays 23.

What is claimed is:

1. A printer comprising:

a paper tray provided in correspondence to each of a plurality of paper sizes;

a paper tray detecting portion for detecting each of said paper sizes corresponding to said paper tray;

an ink sheet cartridge provided in correspondence to each of a plurality of types of ink sheets corresponding to each of a plurality of said paper sizes respectively;

a cartridge detecting portion for detecting each of the types of said ink sheets corresponding to said ink sheet cartridge;

a paper size detecting means for detecting said paper size after said paper and each of said ink sheets are carried to the printing start position; and a control portion finally deciding a combination of a paper and each of said ink sheets subjected to printing based on a result of detection by said paper size detecting means and said cartridge detecting portion after said paper and each of said ink sheets are carried to the printing start position.

2. The printer according to claim 1, wherein said control portion virtually decides a combination of each of said paper sizes corresponding to said paper tray detected by said paper tray detecting portion and each of the types of said ink sheets corresponding to said ink sheet cartridge detected by said cartridge detecting portion before carrying said paper and each of said ink sheets to the printing start position when said combination is a printable combination.

3. The printer according to claim 2, wherein said control portion does not virtually decide said combination of each of said paper sizes corresponding to said paper tray detected by said paper tray detecting portion and each of the types of said ink sheets corresponding to said ink sheet cartridge detected by said cartridge detecting portion but posts abnormality to a user before carrying said paper and each of said ink sheets to the printing start position when said combination is not a printable combination.

4. The printer according to claim 1, wherein said control portion exercises control for finally deciding said combination of said paper and each of said ink sheets subjected to printing and performing printing when normally carrying said paper and each of said ink sheets to the printing start position, and finally decides said combination of said paper and each of said ink sheets subjected to printing after exchanging at least either said paper tray or said ink sheet cartridge and thereafter carrying said paper and each of said ink sheets to the printing start position again when abnormally carrying said paper and each of said ink sheets to the printing start position.

5. The printer according to claim 4, wherein said control portion posts a shortage of each of said ink sheets to a user when abnormally carrying said ink sheets to the printing start position.

6. The printer according to claim 4, wherein said control portion virtually decides a combination of each of said paper sizes corresponding to said paper tray detected by said paper tray detecting portion and each of the types of said ink sheets corresponding to said ink sheet cartridge detected by said cartridge detecting portion when said combination is a printable combination, and determines that said paper is abnormally searched out and posts a paper error to a user if said paper is in short supply and if each of said paper sizes determined when carrying for said paper and said virtually decided each of said paper sizes to the printing start position corresponding to said paper tray detected by said paper tray detecting portion do not correspond to each other.

7. The printer according to claim 1, wherein said paper tray detecting portion detects each of said paper sizes corresponding to said paper tray and said cartridge detecting portion detects each of the types of said ink sheets corresponding to said ink sheet cartridge every time the printer performs printing on single said paper.

8. The printer according to claim 1, further comprising a paper detecting portion for detecting a carried position of said paper, wherein said control portion determines whether or not said paper has been normally searched out on the basis of a result of detection by said paper detecting portion.

9. The printer according to claim 8, further comprising a carrier roller whose rotational frequency is detected by said control portion, wherein said control portion determines each of said paper sizes on the basis of a result of detection of the rotational frequency of said carrier roller required by said paper detecting portion for detecting the rear end of said paper after detecting the front end of said paper.

10. The printer according to claim 1, wherein said control portion finally decides said combination of said paper and each of said ink sheets subjected to printing after carrying said paper and each of said ink sheets to the printing start position in response to a print instruction signal received.

11. A printer comprising a paper tray provided in correspondence to each of a plurality of paper sizes, a paper tray detecting portion for detecting each of said paper sizes, an ink sheet cartridge provided in correspondence to each of a plurality of types of ink sheets corresponding to each of a plurality of said paper sizes respectively, a cartridge detecting portion for detecting each of the types of said ink sheets, a paper detecting portion for detecting a carried position of a paper and a control portion receiving results of detection from said paper tray detecting portion, said cartridge detecting portion and said paper detecting portion, and a paper size detecting means for detecting said paper size after said paper and each of said ink sheets are carried to the printing start position, wherein said paper tray detecting portion detects each of said paper sizes corresponding to said paper tray, said cartridge detecting portion detects each of the types of said ink sheets corresponding to said ink sheet cartridge, and said control portion virtually decides a combination of each of said paper sizes corresponding to said paper tray detected by said paper tray detecting portion and each of the types of said ink sheets corresponding to said ink sheet cartridge detected by said cartridge detecting portion and carries said paper and each of said ink sheets to the printing start position when said combination is a printable combination every printing performed on single said paper in response to a print instruction signal received, determines whether or not said paper has been normally searched out on the basis of a result of detection of said paper detecting portion on said carried position of said paper, exercises control for finally deciding said combination of said paper and each of said ink sheets subjected to printing when said paper and each of said ink sheets have been normally searched out, and finally decides said combination of said paper and each of said ink sheets subjected to printing based on a result of detection by said paper size detecting means and said cartridge detecting portion after said paper and each of said ink sheets are carried to the printing start position again after exchanging at least either said paper tray or said ink sheet cartridge when said paper and each of said ink sheets has been abnormally searched out.

12. The printer according to claim 11, wherein said control portion does not virtually decide said combination of each of said paper sizes corresponding to said paper tray detected by said paper tray detecting portion and each of the types of said ink sheets corresponding to said ink sheet cartridge detected by said cartridge detecting portion but posts abnormality to a user before carrying said paper and each of said ink sheets to the printing start position when said combination is not a printable combination.

13. The printer according to claim 11, wherein said control portion posts a shortage of each of said ink sheets to a user when abnormally carrying each of said ink sheets to the printing start position.

14. The printer according to claim 11, wherein said control portion determines that said paper is abnormally searched out and posts a paper error to a user if said paper is in short supply and if each of said paper sizes determined when carrying said paper and said virtually decided each of paper sizes to the printing start position corresponding to said paper tray detected by said paper tray detecting portion do not correspond to each other.

15. The printer according to claim 11, further comprising a carrier roller whose rotational frequency is detected by said control portion, wherein said control portion determines each of said paper sizes on the basis of a result of detection of the rotational frequency of said carrier roller required by said paper detecting portion for detecting the rear end of said paper after detecting the front end of said paper.

* * * * *